United States Patent [19]

Terada et al.

[11] 4,113,431

[45] Sep. 12, 1978

[54] METHOD FOR DYEING CELLULOSE FIBERS BY DISPERSE DYES

[75] Inventors: Yasuhiko Terada, Kashihara; Jun Yasuda, Osaka; Masao Kuriyama, Itami, all of Japan

[73] Assignee: Shikibo Limited, Osaka, Japan

[21] Appl. No.: 661,825

[22] Filed: Feb. 26, 1976

[30] Foreign Application Priority Data

Feb. 27, 1975 [JP] Japan ..... 50-25440

[51] Int. Cl.[2] ..... D06M 13/00

[52] U.S. Cl. ..... 8/120; 8/2.5 A; 8/40; 8/50; 8/54.2; 8/63; 8/129

[58] Field of Search ..... 8/120 R, 50, 162 R, 8/2.5 A, 63, 129, 40, 120

[56] References Cited

U.S. PATENT DOCUMENTS

| | | | |
|---|---|---|---|
| 1,649,710 | 11/1927 | Leemann et al. | 8/66 |
| 1,679,477 | 8/1928 | Leemann et al. | 8/66 |
| 1,679,480 | 8/1928 | Leemann et al. | 8/66 |
| 1,878,783 | 9/1932 | Landolt | 8/189 |
| 3,519,382 | 7/1970 | Arthur et al. | 8/120 |
| 3,706,525 | 12/1972 | Blackwell et al. | 8/21 C |
| 3,766,163 | 10/1973 | Blackwell et al. | 260/191 |

FOREIGN PATENT DOCUMENTS

| | | |
|---|---|---|
| 1,441,203 | 6/1976 | United Kingdom. |
| 241,854 | 2/1926 | United Kingdom. |
| 319,584 | 11/1930 | United Kingdom. |
| 233,704 | 6/1926 | United Kingdom. |

OTHER PUBLICATIONS

Mullins; C. E., "Acetate Silk and its Dyes", (van Nostrand, New York,) 1927, pp. 334–336.

Matthews, "Textile Fibers", (John Wiley, New York) 1947, pp. 289–291.

Mullins; C. E. et al., Textile Chemist, 1931, 53, pp. 460–463 and 542–544.

Blanchard et al., American Dyesutff Reporter, Jul. 1976, pp. 26–34 and 65.

Moncrieff, "Man-Made Fibres", (Wiley) 1970, pp. 233–234.

Vickerstaff, "The Physical Chemistry of Dyeing", (Oliver and Boyd) 1950, pp. 253 and 262.

Willard and Schwenker, "Textile Research Journal, 1967, 37, (No. 4), pp. 316–323.

*Primary Examiner*—A. Lionel Clingman

*Attorney, Agent, or Firm*—Armstrong, Nikaido, Marmelstein & Kubovcik

[57] ABSTRACT

A cellulose fiber derivative is provided, along with methods of its production, in order to give color features to cellulose fiber compositions while using disperse dyes. The cellulose fiber derivative includes an acyl group of formula

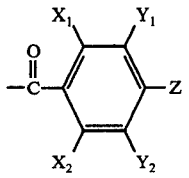

wherein $X_1$, $X_2$, $Y_1$, $Y_2$ and Z are selected individually from the group consisting of hydrogen, halogen, alkyl, nitro, methoxy, phenylazo or amino, introduced into said cellulose fiber through chemical reaction with the hydroxyl groups of said cellulose fiber to the extent of a substitution degree of more than 0.10.

10 Claims, No Drawings

METHOD FOR DYEING CELLULOSE FIBERS BY DISPERSE DYES

BACKGROUND OF THE INVENTION

1. Field of the Invention

This invention relates to a method for dyeing cellulose fibers using a disperse dye.

2. Description of the Prior Art

In general, the disperse dye has an excellent color affinity to synthetic fibers, especially to polyester fibers, but has poor color affinity to the cellulose fibers. Thus, it is not possible to dye with the disperse dye a product such as a mixed yarn or union cloth of the cellulose and synthetic fibers. Such a product can be dyed by a process in which the disperse dye is used in combination with the use of a direct dye, reactive dye, soluble vat dye, or vat dye; the synthetic fiber portions are at first dyed by the disperse dyes, then the cellulose fiber portions are dyed by said direct dyes, reactive dyes, soluble vat dyes or vat dye. The process, however, has disadvantages because the process is intricate, time-consuming and gives a product with poor color fastness.

The above-mentioned product can be dyed further by a pigment dyeing process and by a process wherein Dyblen (registered trademark) dyes are used. The pigment dyeing process has the advantages that simultaneous printing can be carried out and operations are simple, but has disadvantages that it gives a product having poor color fastness to rubbing and having a rough, coarse tactility. Said Dyblen dyeing process has advantages that simultaneous printing can also be carried out, but has disadvantages in that it gives a product having poor color fastness and having a low resistance to organic solvents. Thus, none of the conventional processes could furnish good dye fastness to a product having the form of mixed yarns or union cloth of cellulose fibers and polyester synthetic fibers. Therefore, those skilled in the art have sought a process which can give color fastness to a product which is composed of mixed yarns or union cloth of cellulose fibers, polyester synthetic fibers. The inventors have invented a process wherein the product can be dyed by the disperse dyes with good color fastness.

It is known that the cellulose fibers are turned into fibers which have a good affinity to the disperse dyes and can be dyed by the disperse dyes when the cellulose fibers are either esterified or etherified. However, the thus esterified or etherified product did not have practical use, because the product loses soft tactility to become stiff and does not show good color fastness. For example, a method is known in which the cellulose fibers are acylated by fatty acid such as acetic acid, propionic acid and butyric acid to improve color affinity of the cellulose fibers, and then the resulting product is dyed with the disperse dyes; however, the product does not show good color fastness, especially color fastness to washing, though the product is more or less improved in color affinity. In order to improve further the color fastness, the cellulose fibers must be more highly acylated by the fatty acid, or a fixing agent must be further used; however, if so, the resulting product is of no practical use owing to inferior tactility.

The inventors intended to obtain cellulose fiber derivatives which could be easily dyed by the disperse dyes, and tried various chemical treatments for improving color fastness of the cellulose fibers. Particularly, the inventors tried to esterify the cellulose fibers by various acids or acid derivatives, for example, benzoic acid, and also to etherify the cellulose fibers, for example, by acrylonitrile. As a result, the inventors have found that the cellulose fibers can be converted into a product, without deteriorating both the tactility and hygroscopic property of the cellulose fibers, which product can be dyed by the disperse dyes clearly and with good color fastness, if the cellulose fibers are appropriately acylated by an aromatic acid such as benzoic acid, and when a substitution degree of acyl group is maintained at an appropriate value. These findings comprise the invention.

SUMMARY OF THE INVENTION

This invention provides a method for dyeing cellulose fibers by disperse dyes which comprises introducing at first into cellulose fibers an acyl group represented by the general formula

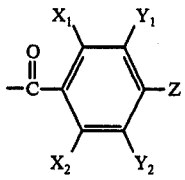

Formula 1 to a substitution degree of more than 0.10, and then dyeing the resultant product by disperse dyes (wherein $X_1$, $X_2$, $Y_1$, $Y_2$ and Z represent hydrogen, halogen, alkyl, nitro, methoxy, phenylazo, or amino groups).

The cellulose fibers referred to in this invention may be natural fibers such as cotton fibers or may be regenerated artificial fibers such as viscose rayon. Furthermore, the cellulose fibers may be in the form of cellulose fibers alone, or may be in the form of mixed yarns or union cloth of cellulose fibers and other synthetic fibers. Furthermore, the cellulose fibers referred to herein may have not yet been formed into a yarn by spinning; they may be in the form of yarns, or they may be in the form of fabrics which are prepared by weaving or knitting the yarns. Regarding these possible forms of cellulose fibers, this invention brings about a conspicuous effect when the cellulose fibers are in the form of mixed yarn or union cloth together with the polyester fibers.

DETAILED DESCRIPTION OF THE INVENTION

In this invention, an aromatic acyl group is introduced into the cellulose fibers, which group is represented by the general formula

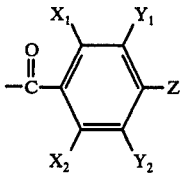

Formula 1

In the formula, $X_1$, $X_2$, $Y_1$, $Y_2$ and Z are members selected from the group hydrogen, halogen, alkyl, nitro, methoxy, phenylazo, and amino groups. The acyl group belonging to said formula 1 is, for example, benzoyl group, halogenated benzoyl group, alkyl benzoyl group, nitro benzoyl group, methoxy benzoyl group, phenylazo benzoyl group, amino benzoyl group and those benzoyl groups, containing two or more of the above substitutents in combination. The acyl group is introduced into cellulose fiber through chemical reaction with the hydroxyl groups of cellulose fiber.

In this invention, the aromatic acyl group represented by formula 1 should be introduced into the cellulose fibers to a substitution degree of more than 0.10. The substitution degree means a mean value of the number of hydroxyl groups substituted by the acyl group in three hydroxyl groups contained in one glucose unit of cellulose fibers. The substitution degree is, in fact, calculated by a weight method in the following manner:

$$\text{substitution degree} = \left(\begin{matrix}\text{fabric weight}\\ \text{after treatment}\end{matrix} - \begin{matrix}\text{fabric weight}\\ \text{before treatment}\end{matrix}\right) \times 162.08 \div \begin{matrix}\text{fabric weight}\\ \text{before treatment}\end{matrix}\left(\begin{matrix}\text{molecular weight}\\ \text{of an ocyl group}\end{matrix} - 1.01\right)$$

wherein 162.08 is a molecular weight of one glucose unit, and 1.01 is an atomic weight of hydrogen.

Various methods may be used in order to introduce the acyl group represented by formula 1 into the cellulose fibers. One method is that the cellulose fibers are immersed at first in an aqueous alkali solution and then immersed in an acid chloride solution; the second method is that the acid chloride is at first added to the cellulose fibers, and the resulting mixture is heated in the presence of a basic organic solvent; the third method is that the cellulose fibers are reacted with an acid anhydride in the presence of an acid catalyst or a reaction promoter.

More particularly, the first method immerses homogeneous cellulose fibers or combinations of a cellulose fiber and synthetic fiber, in the form of mixed yarn or union cloth, in an aqueous alkali solution such as sodium hydroxide or potassium hydroxide at a concentration within the range of 5 to 35 % by weight. The immersion may be carried out at a temperature within the range of 10° to 50° C. The fibers are squeezed, and then immersed in an acid chloride solution which has a concentration within the range of 10 to 100 % by weight and at a temperature of between 10° and 90° C. The acid chloride may be benzoyl chloride, para-chlorobenzoyl chloride, toluoyl chloride, paranitrobenzoyl chloride, para-methoxybenzoyl chloride or paraphenylazobenzoyl chloride. The general formula of the acid chlorides is that of Formula 1 with an atom of chlorine bonded to the carbonyl carbon. After immersion in the acid chloride, the acylated cellulose fiber derivatives are squeezed, washed with alkali, rinsed with water, dried, and thereby acylated cellulose fibers are recovered.

According to the second method, cellulose fibers react with the acid chloride at a temperature within the range of 30° C to 90° C in the presence of a basic organic solvent like pyridine, quinoline and dimethyl-aniline. Then the acylated cellulose fiber is recovered. In this method, the selection of an appropriate temperature is guided by the time to be allowed for heating. The concentration of acid chloride in the basic solvent should be within a range of 5 to 40 % by weight.

In the third method, the temperature should be within a range of 10° to 50° C. The acid anhydride can be isatoic and benzoic. Its concentration in an aqueous solution with an acid catalyst is within the range of 20 to 50 % by weight.

In this invention, the acyl group should be introduced to have substituion degree of more than 0.10. The substitution degree can be controlled by adjusting the concentration of chemical agent used therein, the temperature for treatment, and the period of time for the treatment. For example, the substitution degree can be increased by increasing the concentration of the chemical agent and the temperature for the treatment and by extending the period of time for the treatment. Therefore, the necessary conditions for a particular degree of substitution can be obtained by carrying out several experiments wherein these factors are fixed at respective arbitrary values. The reason why the substitution degree should be more than 0.10 is based on the experimental confirmations. If the substitution degree is less than 0.10, then dyed fibers have a deteriorated color fastness to washing and do not show clear and vivid tints. If the substitution degree is more than 0.10, then the dyed fibers show clear and vivid tints and have excellent color fastness. If the substitution degree is increased to more than 0.50, then the cellulose fibers are deteriorated in tactility and in hygroscopic properties. Thus, it is preferable to maintain the substitution degree within a range between 0.10 and 0.50.

In this invention, after the acyl group has been introduced into the cellulose fibers to a substitution degree of more than 0.10, the cellulose fiber derivatives are dyed by the disperse dye. For dyeing the fibers in this case, the conventional method for dyeing polyester fibers can be employed without modificaton; for example, a high temperature dyeing method and a thermosol dyeing method can be used without alteration. Furthermore, printing can be carried out, and in order to improve fixation of the dye, a thermosol method and a steaming method by means of the saturated steam can be also employed.

According to this invention, the cellulose fibers can be converted into fibers which can be dyed by the disperse dye although the cellulose fibers themselves could not be dyed by the disperse dye. Furthermore, the cellulose fiber derivatives, when dyed by the disperse dye, possess excellent color fastness. Thus, according to this invention, it is possible to dye with a disperse dye a fabric or yarn in the form of only cellulose fibers as well as mixed yarns or union cloth in the form of cellulose fibers and synthetic fibers. Excellent color fastness is displayed over the whole fabric or yarn. Furthermore, such dyeing can be carried out in one step and in one bath.

Further, according to this invention, the acyl group represented by the general formula 1 is introduced to a substitution degree of more than 0.10, and therefore the resulting fibers have excellent tactility. With conventional processes, when the acyl group has been introduced into the cellulose fibers, the resulting yarns or fabrics are generally coarse, stiff and lack a pliant touch. According to this invention, however, the acylated cellulose fibers possess a pliant touch. This can be confirmed by measuring and comparing extensibility, compressibility, flexibility and shear stiffness of the yarns obtained by the conventional methods and the invented method. In general, the yarns become progressively improved when values in the extensibility, flexibility and shear stress are decreased, and the yarns are also progressively improved as the values of compressibility increase. If cellulose fibers are esterified by other groups than the groups represented by formula 1, then the cellulose fibers must be more highly esterified in order to give good color fastness to the disperse dyes, and therefore the resulting product is deteriorated by considerable increases of respective values in the extensibility, flexibility and shear stress and by decrease of value in the compressibility. As a result, for example, yarns composed of such product are generally coarse, stiff and inflexible. By contrast if the acyl group represented by Formula 1 is introduced into cellulose fibers to a substitution degree of between 0.10 and 0.50, then the resulting cellulose fiber derivatives have measured values of extensibility, flexibility, shear stress and compressibility which are similar to the values of untreated cellulose fibers. The following table evidences this similarity. Therefore, the cellulose fiber derivatives provided by this invention have the desirable properties of untreated cellulose fiber while possessing the capacity to be dyed using disperse dyes to give good color fastness.

| Properties | | | Untreated knitted fabric | Benzoylated knitted fabric having the substitution degree of 0.32 | Benzoylated knitted fabric having the substitution degree of 0.63 |
|---|---|---|---|---|---|
| Extensibility | Young's Modulus (net) ($g/cm^2$) $\times 10^4$ | W | 0.49 | 0.52 | 0.98 |
| | | C | 0.71 | 0.83 | 1.07 |
| | Maximum Extension (g/cm) $\times 10^3$ | W | 0.16 | 0.18 | 0.40 |
| | | C | 0.20 | 0.23 | 0.32 |
| Compressibility | Compressive Ratio (%). | | 61.2 | 60.5 | 40.5 |
| Flexibility | Maximum Bending Moment (g . cm/cm) | W | 3.41 | 3.97 | 4.80 |
| | | C | 1.51 | 1.60 | 1.85 |
| | Flexible Stiffness ($g . cm^2/cm$) | W | 3.22 | 3.45 | 4.72 |
| | | C | 0.97 | 1.13 | 1.48 |
| Shearing Property | Maximum Shearing Force (g/cm) $\times$ 10 | W | 0.51 | 0.60 | 0.98 |
| | | C | 0.63 | 0.70 | 0.97 |
| | Shearing Stiffness (g/cm) $\times 10^{-2}$ | W | 8.73 | 9.01 | 14.5 |
| | | C | 10.1 | 11.5 | 15.8 |

In the table, benzoylated knitted fabric was prepared by introducing benzoyl group into a knitted fabric composed of thirty count cotton yarns according to the second method; W represents the wale direction, C the course directions; the flexibility and shearing property are shown in values per unit width of the cloth; extensibility is measured by JIS L-1018, 5-21 (1962), compressibility is measured by JIS L-1018, 5-22 (1962), flexibility is measured by a method described in J. D. Owen; J. Text, Inst., 57, T435 (1966), and shearing property is measured by a method described in S. M. Spivak; J. Text. Res., 36, 1056 (1966).

From the table it is observed that the benzoylated knitted fabric shows less deviations from the untreated knitted fabric in case of 0.32 substitution degree, and more deviations in case of 0.63 substitution degree, and hence it is concluded that a highly substituted product has a tendency to lose superior characteristics of the cellulose fibers and to be of inferior tactility.

Furthermore, a conspicuous advantage of this invention is that the thus acylated cellulose fibers can be printed by applying a sublimation transfer printing method. The sublimation transfer printing method is a method in which a specific disperse dye which is sublimable at high temperatures is printed beforehand on a support such as a paper or a film, the support is placed on a fabric with the printed surface facing to the fabric, the support is heated to sublimate the dye, thus the dye is transferred to the fabric, and as a result the printing is carried out. The dyes to which the sublimation transfer printing is applicable are limited to dyes which can sublimate at high temperatures. The fibers to which the sublimation transfer printing have been applicable are the synthetic fibers, such as fibers made of polyester, acryl, polyamide, vinylon and polyurethane; cellulose fibers could not be dyed by the sublimation transfer printing. An advantage of the present invention is that the cellulose fibers are converted into fibers to which the sublimation transfer printing is applicable.

By way of example, this invention is further explained in detail.

EXAMPLE 1

In this example, a fabric was used which was composed of cellulose fibers alone. Benzoyl group was introduced into the fabric by the first method mentioned above, and the resulting fabric was dyed by the conventional thermofixation method, known under the trademark of "THERMOSOL", particulars of which are as follows:

100g. of a cotton cloth was at first immersed into 20% aqueous sodium hydroxide solution at 20° C, then squeezed to the squeezing ratio of 100%. Thereafter, the cotton cloth was immersed in benzoyl chloride at 15° C for 4 minutes, then taken out therefrom, washed in 2% aqueous sodium carbonate solution at 95° C for 10 minutes, then further washed in water, and dried. Thus, benzoylated cotton cloth was obtained having the substitution degree of 0.32.

Apart from this, an aqueous solution was prepared which contained 40g/liter of MIKETON polyester red violet HR (disperse dye made by Mitsui Chemical Co.) and 2g/liter of sodium arginate, and the solution was put in dye bath. Said benzoylated cotton cloth was immersed in the dyed bath, then squeezed to the squeezing ratio of 60%, subjected to intermediary drying at 70° C for 10 minutes, heat-treated at 200° C for 90 seconds, then washed well in water, and thus the cloth was dyed.

The dyed cloth as subjected to reduction cleaning in aqueous solution containing 2g/liter of sodium hydroxide, 2g/liter of hydrosulphite, and 0.5g/liter of RAKKOHRU BL (made by Meisei Kagaku C.) at 50° C for 15 minutes for after treatment. As a result, a dyed product was obtained having a deep, clear, purplish red color.

As to the dyed cloth, the color fastness as measured according to the method described in Japan Industrial Standard (JIS). As a result, it was found that color fastness to washing (JIS-L-1045 MC-4) was the fourth grade in assessing change in color, color fastness to sunlight (JIS -1044, irradiated for 40 hours) was the sixth grade, and consequently, it was confirmed that dyed color as of excellent fastness.

EXAMPLE 2

In this example, a cloth was used which was composed of yarns mixed with cotton and polyester fibers, para-methoxybenzoyl group was introduced into the cloth by the second method mentioned above, and then the resulting cloth was dyed by a high temperature dyeing method, particulars of which are as follows:

For the cellulose fibers was used a cloth which was prepared by weaving yarns mixed with 50% of cotton fibers and 50% of polyester fibers. 10g of the cloth was immersed in 150g. of pyridine solution containing 20g. of para-methoxybenzoyl chloride, and was left to immersion at 60° C for 30 minutes. Thereafter, the cloth was taken out, washed well in water, dried, and thus para-methoxybenzoylated cloth was obtained which had the substitution degree of 0.27.

Apart from this, an aqueous solution was prepared which contained 200 ml. of water and 0.2 g. of condensation product of 2-naphthol 6-sulphonic acid, cresol, and formaldehyde. 1g. of MIKETON polyester red violet FR was dispersed in the aqueous solution, and the resulting solution was put in a dye bath. The said cloth was immersed in the dye bath and left at about 130° C for 60 minutes to dye it.

For after-treatment was prepared 500 ml. of aqueous solution containing 2g. of sodium hydroxide and 2g. of hydrosulphite. Said cloth was subjected to reduction cleaning in the aqueous solution, then soaped at 80° C for 10 minutes in 500 ml. of aqueous solution containing 1g. of sulphuric acid ester of higher alcohol and 1g. of anhydrous sodium carbonate, washed in water, and at last dried. As a result, the cloth was obtained which was clearly and deeply dyed in a purplish red color both in polyester fiber portions and in cotton fiber portions.

As to the resulting cloth, color fastness was measured in the same manner as in Example 1, and it was found that the color fastness to washing was the fourth grade in assessing change in color, the bleeding was the fourth grade both in para-methoxybenzoylated cotton fibers and in polyester fibers, the color fastness to sunlight was the sixth grade, and consequently it was confirmed that the color was dyed with excellent fastness.

EXAMPLE 3

In this example, a cloth was used which was composed of 100% cotton fibers, orth-aminobenzoyl group was introduced into the cloth by the third method mentioned above, and then the resulting cloth was dyed by the conventional printing method, particulars of which are as follows:

A solution was prepared which was composed of 26.5% of isatoic acid anhydride, 4.5% of potassium acetate, 9% of water, and 60% of dimethyl sulfoxide. Said cloth was immersed in the solution then squeezed to the squeezing ratio of 100%, dried at 80° C for 5 minutes, and then heat-treated at 140° C for 6 minues. Thereafter, the cloth was washed well in water, dried, and thus ortho-aminobenzoylated cloth was obtained which had the substitution degree of 0.22.

Apart from this, a mixture was prepared which contained 40g./liter of SUMIKARON Brilliant Red SE-3BL (disperse dye made by Sumitomo Kagaku Co.), 10g./liter of Revatol S (reducing agent made by Sandox - its main ingredient was said to be sodium metanitrobenzenesulfonate), 30g./liter of EMALFOR EL (surface active agent), and 500g./liter of stock paste (INDALCA PA-3, 12% aqueous solution, low viscosity printing paste). The mixture was used for a printing ink, and the said cloth was printed by the printing ink. The cloth was then dried at 80° C for 5 minutes, heat-treated at 200° C for 90 seconds, thereafter washed well in water, and thus the cloth was dyed.

In order to after-treat the cloth, the cloth was subjected to reduction cleaning at 50° C for 15 minutes in an aqueous solution containing 2g./liter of sodium hydroxide, 2g./liter of hydrosulphite, and 0.5g./liter of RAKKOHRU BL. As a result, the cloth was obtained which was dyed in a clear, deep red color.

As to the resulting cloth, the fastness was measured in the same manner as in Example 1, and it was found that the assessing change in color was the fourth grade in the color fastness to washing, that the bleeding was the fourth grade, and that the color fastness to sunlight was the sixth grade, and consequently the cloth was confirmed to be of excellent fastness.

EXAMPLE 4

In this example, use was made of a cloth composed of 100% cotton fibers, into which meta-nitrobenzoyl group was introduced by the second method mentioned above, the resulting cloth was printed by the conventional method, then was treated by steaming dyes, particulars of which are as follows:

10g. of the cotton cloth was immersed in 150g. of pyridine solution containing 15g. of meta-nitrobenzoyl chloride, reacted therewith at 50° C for 60 minutes, then washed well in water to obtain a meta-nitrobenoylated cotton cloth having the substitution degree of 0.31.

For a printing ink was prepared a mixture containing 40g./liter of SUMIKARON Brilliant Blue S-BL, 10g./liter of REVATOL S (which was used in Example 3), 1g./liter of tartaric acid, and 500g./liter of stock paste (which as used in Example 3). The said metanitrobenzoylated cloth was printed by the mixture and then steamed at 120° C for 30 minutes.

In order to after-treat the cloth, the cloth was well washed in water, and then subjected to reduction cleaning at 50° C for 15 minutes in 500 ml. of aqueous solution containing 2g./liter of sodium hydroxide, 2g./liter of hydrosulphite, and 0.5g./liter of RAKKOHRU BL (which was used in Example 3). As a result, the cloth was obtained which was dyed in a clear, deep blue color.

As to the cloth, the color fastness was measured and it found that the assessing change in color was the fourth grade in the color fastness to washing, that bleeding was the fourth grade, and that the color fastness to sunlight was sixth grade, and consequently it was confirmed that the cloth had an excellent color fastness.

EXAMPLE 5–11

In these examples, the sublimation transfer printing method was applied to the benzoylated cotton cloth (the substitution degree was 0.32), which as obtained in Example 1, using various disperse dyes for printing inks, particulars of which are as follows:

Each of the printing inks was an aqueous mixture containing 25g./liter of carboxymethyl cellulose and 40g./liter of the disperse dye indicated in the table hereinbelow, which dye is liable to sublimate. Each printing ink was printed on a paper by a screen printing machine to obtain a transfer paper. The transfer paper as placed on the said benzoylated cotton cloth with its printed surface facing to the cloth, and they were heated and pressed at 200° C for 30 seconds from upper side of the paper. As a result, each printing ink on the paper was transferred to the cotton cloth to produce a dyed cloth, which had a deep, clear color.

As to the dyed cloth the color fastness to washing and the color fastness to sunlight were measured. Measurement results were indicated in the table. All clothes were confirmed to have excellent color fastness.

| Ex. No. | Name of disperse dye | Color fastness to washing (JIS L-1045 MC-4) Assessing change in color | Bleeding (Converted cloth) | Color fastness to sunlight (JIS L-1044) |
|---|---|---|---|---|
| 5 | Kayalon fast yellow | 5 | 4 | 7 |
| 6 | Kayalon polyester yellow YLF | 4 | 5 | 7 |
| 7 | Miketon fast red violet R | 3 | 4 | 6 |
| 8 | Kayalon fast violet BB | 5 | 4 | 4 |
| 9 | Miketon fast blue extra | 5 | 4 | 3 |
| 10 | Miketon fast brilliant blue B | 4 | 4 | 4 |
| 11 | Sumikaron blue R | 4 | 4 | 5 |

What is claimed is:

1. A method for dyeing cellulose fiber with improved color fastness using disperse dyes which comprises the steps of: reacting cellulose fiber with an aromatic acylating agent having an acyl group represented by a general formula

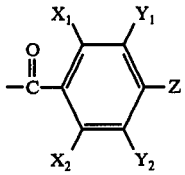

wherein $X_1$, $X_2$, $Y_1$, $Y_2$ and Z are members selected from the group consisting of hydrogen, halogen, alkyl, nitro, methoxy, phenylazo, and amino groups; controlling the reaction of cellulose fiber with the acylating agent by adjusting the concentration of reactants, temperature and reaction time whereby the acyl group is introduced into the cellulose fiber to form a cellulose fiber derivative having a substitution degree of between 0.10 and 0.50; recovering the cellulose fiber derivative; and contacting the cellulose fiber derivative with disperse dyes.

2. A method as recited in claim 1, which comprises: immersing the cellulose fibers in aqueous alkali solution of a concentration within the range of 5 to 35% by weight at a temperature within the range of 10° to 50° C; removing and squeezing the cellulose fibers from the solution; immersing the alkali treated fibers in a solution of an acid chloride, which has the general formula

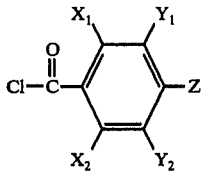

wherein $X_1$, $X_2$, $Y_1$, $Y_2$ and Z are members selected from the group consisting of hydrogen, halogen, alkyl, nitro, methoxy, phenylazo and amino, the concentration of the acid chloride being within a range of 10 to 100% by weight and the temperature being within a range of 10°–90° C; and recovering the cellulose fiber derivative.

3. A method as recited in claim 2 wherein the acid chloride is a member selected from the group consisting of:

(i) benzoyl chloride,
(ii) para-methoxybenzoyl chloride,
(iii) para-chlorobenzoyl chloride,
(iv) toluoyl chloride
(v) para-nitrobenzoyl chloride and
(vi) para-phenylazo benzoyl chloride.

4. A method as recited in claim 1, which comprises: reacting the cellulose fiber with acid chloride, which has the general formula

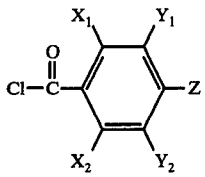

wherein $X_1$, $X_2$, $Y_1$, $Y_2$ and Z are members selected from the group consisting of hydrogen, halogen, alkyl, nitro, methoxy, phenylazo and amino, in a basic organic solvent at a temperature within the range of 30° to 90° C, and the concentration of the acid chloride in the basic solvent being within the range of 5 to 40% by weight; and recovering the cellulose derivative.

5. A method as recited in claim 4, wherein the basic organic solvent is a member selected from the group consisting of pyridine, quinoline and dimethyl-aniline.

6. A method as recited in claim 1 wherein the cellulose fiber derivative is contacted with disperse dyes by placing on the cellulose derivative fabric a support having a sublimable disperse dye on one surface thereof, with the printed surface facing towards the cellulose derivative fabric; and heating the support simultaneously contacting the support with the cellulose derivative fabric whereby the sublimable disperse dye is transferred onto the fabric.

7. A method as recited in claim 1, wherein said aromatic acyl group is a member selected from the group consisting of benzoyl, para-methoxybenzoyl, orthoaminobenzoyl, and metanitrobenzoyl.

8. A method as recited in claim 1 which comprises: reacting cellulose fiber with an aqueous acid anhydride solution of a concentration within the range of 20–50% by weight in the presence of a reaction promotor at a temperature within the range of 10°–50° C.

9. A process as recited in claim 8 in which the acid anhydride is a member selected from the group consisting of isatoic and benzoic acid anhydrides.

10. A method as recited in claim 8 wherein the reaction promotor is an acid catalyst.

* * * * *